US012290727B2

(12) United States Patent
Bierman et al.

(10) Patent No.: US 12,290,727 B2
(45) Date of Patent: May 6, 2025

(54) METHODS AND SYSTEMS FOR A FLYING DISC GAME

(71) Applicants: Clinton Bierman, Bridport, VT (US); Paul Choiniere, Bridport, VT (US)

(72) Inventors: Clinton Bierman, Bridport, VT (US); Paul Choiniere, Bridport, VT (US)

( * ) Notice: Subject to any disclaimer, the term of this patent is extended or adjusted under 35 U.S.C. 154(b) by 778 days.

(21) Appl. No.: 17/455,988

(22) Filed: Nov. 22, 2021

(65) Prior Publication Data

US 2022/0161112 A1 May 26, 2022

Related U.S. Application Data

(60) Provisional application No. 63/116,824, filed on Nov. 21, 2020.

(51) Int. Cl.
*A63B 67/06* (2006.01)
*A63B 71/02* (2006.01)

(52) U.S. Cl.
CPC ..... *A63B 67/06* (2013.01); *A63B 71/023* (2013.01); *A63B 2071/024* (2013.01); *A63B 2210/50* (2013.01)

(58) Field of Classification Search
CPC .. A63B 67/06; A63B 71/023; A63B 2071/024
See application file for complete search history.

(56) References Cited

U.S. PATENT DOCUMENTS

| | | | | |
|---|---|---|---|---|
| 5,597,160 | A * | 1/1997 | Mims | A63B 69/407 124/16 |
| 7,500,675 | B2 | 3/2009 | Sandman | |
| 7,857,718 | B2 | 12/2010 | Tarng et al. | |
| 9,339,708 | B2 | 5/2016 | Gonzalez | |
| 2003/0143922 | A1* | 7/2003 | Du | A63H 37/00 124/16 |
| 2009/0143175 | A1 | 6/2009 | Tarng et al. | |
| 2011/0195805 | A1* | 8/2011 | Sliger | A63B 67/06 473/470 |
| 2014/0121039 | A1* | 5/2014 | Robinson | A63B 69/0079 473/423 |
| 2014/0243116 | A1* | 8/2014 | Durham | A63B 69/0075 473/417 |
| 2018/0036615 | A1* | 2/2018 | Thurber | A63B 69/0091 |

* cited by examiner

*Primary Examiner* — Eugene L Kim
*Assistant Examiner* — Christopher Glenn
(74) *Attorney, Agent, or Firm* — Matthew J Patterson

(57) ABSTRACT

A system and method for playing a flying disc game is disclosed. A goal post having a vertical orientation includes a pop-up piston upon which an object can be placed in an armed position is disclosed. The goal post includes a target that when struck by a flying disc ejects the object into the air. A method of playing a flying disc game with such a goal post is further disclosed.

20 Claims, 7 Drawing Sheets

METHODS AND SYSTEMS FOR A FLYING DISC GAME

CROSS REFERENCE TO RELATED APPLICATIONS

This application claims the benefit of U.S. Provisional Patent Application Ser. No. 63/116,824 filed 21 Nov. 2020. The disclosure of the application above is incorporated herein by reference in their entirety.

BACKGROUND

Field of the Disclosure

The present invention relates generally to the methods and systems for playing games and more specifically it relates to systems and methods for playing a game using a flying disc.

Description of the Related Art

There are many prior art games that utilize flying discs in some aspect of play. One common such game is disc golf, sometimes called "folf". It is a flying disc sport in which players throw a disc at a target; it is played using rules similar to golf. It is usually played on a course with 9 or 18 holes. Players complete a hole by throwing a disc from a tee area toward a target, throwing again from where the previous throw landed, until the target is reached. Usually, the number of throws a player uses to reach each target is tallied (often in relation to par), and players seek to complete each hole in the lowest number of total throws. One such disc golf target is disclosed in U.S. Pat. No. 7,500,675B2.

Another popular flying disc game is Kan Jam® which is a is a flying disc game, played with a flying disc and two cans into which players deflect the disc or passes the disc directly into the can through a narrow slot. A version of Kan Jam® is disclosed in U.S. Pat. No. 5,382,028A.

Another very popular flying disc game involves knocking an object (or objects) off of a pole using a flying disc either by hitting the pole or the object itself. Such a game is commonly referred to as "Polish Horseshoes" and it is an outdoor game played between two teams of two people using a flying disc, two objects such as glass bottles, and poles pushed into the ground. The game is played by the players taking turns throwing a flying disc at the pole and the glass bottle that rests on a platform on top of the poles. The two stakes are typically flexible and the striking of the stake by the flying disc causes the bottle to be dislodged from the stake and fall to the ground due to gravity. Various similar embodiments are disclosed in US Patent Applications US20060103072A1, US20080224409A1 and US20130026712A1. Another prior art version of Polish Horseshoes is Sticks 'N Cups (sticksncups.com) which comprises two pairs of aluminum poles inserted into the ground with plastic cups placed on top of the poles in an inverted position. As discussed herein before the poles are thin and flexible and the striking of the pole causes the cup to be dislodged from the pole and fall to the ground propelled by gravity. The goal of the game is for the throwing team (offense) to successfully get the cup to hit the ground and for the opposite non-throwing team (defense) to catch the cup before it hits the ground. Another variation of this prior art game is Cup Check (cupcheckgame.com) wherein the poles are segmented, and they include an intermediate section which includes a coil spring co-axially coupled to section of the pole. The spring produces a whipping action that propels the cup in a non-predicable horizontal direction when struck by the flying disc. This whipping action exacerbates the flexibility of the aforementioned flexible poles of the prior art and makes it more difficult for the defensive team to catch the dislodged cup. A major problem with the Polish Horseshoe games of the prior art is that the object is propelled to the ground by gravity the instant it is dislodged from the pole. Another problem with the games of the prior art is that there is no active system or mechanism to ensure that the object is dislodged from the pole if there is a successful strike by a player.

In view of the foregoing, there is a need for an improved system and method for a game using a flying disc.

SUMMARY OF THE INVENTION

One general aspect includes a goal post which goal post also includes an elongated pole having a top section and a bottom section where at least a portion of the top section may include a tubular body, where the tubular body includes a trigger slot disposed therein a target may include an elongated tubular structure pivotably disposed over a portion of the top section having a target slot positioned on a back side thereof a spring disposed within the tubular body and a piston having a trigger pin disposed in a side thereof, the piston disposed within the tubular body positioned against the spring, the trigger pin retained within the trigger slot, where the spring is configured to produce a biasing force against the piston.

Implementations may include one or more of the following features. The goal post where the piston is configured to be positioned in a downward position and the trigger pin positioned within the target slot in an armed position. The trigger pin is configured to be released from the target slot when the target is impacted by an object causing the spring to force the piston into an upward position in a fired position. The object is ejected from the top portion of the piston in the fired position. A top end of the bottom section is slidably removably connected to a bottom end of the middle section and a top end of the middle section is slidably removably connected to a bottom end of the top section. The spike is adapted to stably position the goal post in a vertical orientation within a portion of the ground.

One general aspect includes a plurality of goal posts, each goal post may include an elongated pole having a top section and a bottom section where at least a portion of the top section may include a tubular body, where the tubular body includes a trigger slot disposed therein a target may include an elongated tubular structure pivotably disposed over a portion of the top section having a target slot positioned on a back side thereof a spring disposed within the tubular body a piston having a trigger pin disposed in a side thereof, the piston disposed within the tubular body positioned against the spring, the trigger pin retained within the trigger slot, where the spring is configured to produce a biasing force against the piston and the piston configured to be positioned in a downward position and the trigger pin positioned within the target slot in an armed position. The game also includes an object disposed on a top portion of the piston each of the plurality goal posts in the armed position at least one flying disc, and where one of the trigger pins is configured to be released from the target slot when the target is impacted by the at least one flying disc causing the spring to force the piston into an upward position in a fired position and ejecting the object from the piston.

Implementations may include one or more of the following features. The flying disc game may include a plurality of bases, each of the plurality of bases may include a rectangular cuboid that includes at least one hole in a top configured to releasably stabilize at least one of the plurality of goal posts therein and a plurality of legs configured to stabilize the base. The flying disc game may include at least one portable base assembly may include a frame may include a top portion, a bottom portion opposite the top portion, a first side portion connecting a first end of the top portion to a first end of the bottom portion and a second side portion connecting a second end of the top portion to a second end of the bottom portion a base plate rotatbly coupled to the frame proximate the bottom portion at least one post holder mounted to the frame and configured to releasably position at least one of the plurality of goal posts therein and at least one attachment hook positioned on the top portion of the frame. The at least one attachment hook is adapted to be positioned over the upper edge and where the base plate is configured to be positioned against the bottom side to position the at least one post holder in a vertical position and to releasably secure the at least one portable base assembly to the foundation.

One general aspect includes a method of playing a flying disc game. The method of playing also includes supplying at least two goal posts each configured to propel an object in an upward direction when a target of the goal post is struck with a flying disc positioning the at least two goal posts in a vertical orientation a first distance apart setting the at least two goal posts in an armed position placing the object on a top portion of each of the at least two goal posts attempting to strike the target with the flying disc, by an offensive player, of at least one of the at least two goal posts and attempting to catch the object, by a defensive player, if the object is ejected from at least one of the at least two goal posts.

Implementations may include one or more of the following features. The method of playing a flying disc game may include supplying a first pair of goal posts and a second pair of goal posts each configured to propel an object in an upward direction when the target of and of the first pair of goal posts and the second pair of goal posts is struck with the flying disc positioning a first pair of the goal posts in a vertical orientation at a first end of a playing field separated by a second distance apart along a first goal line positioning the second pair of goal posts in a vertical orientation at a second end of a playing field separated by a third distance apart along a second goal line and where the first goal line and the second goal line are parallel to each other and are positioned at the first distance apart. The method of playing a flying disc game may include providing a first set of players and a second set of players alternating the first set of players and the second set of players between an offensive team of players and a defensive team of players and awarding points to the first set of players and the second set of players upon an occurrence of predetermined events. The method of playing a flying disc game may include propelling the flying disc by one the offensive team of players at one of the first pair of goal posts and the second pair of goal posts and awarding points to the offensive team of players if the flying disc passes between, without striking, one of the first pair of goal posts and the second pair of goal posts. The method of playing a flying disc game may include awarding points to the offensive team of players if the flying disc strikes the target of one of the first pair of goal posts and the second pair of goal posts and causes the object to be propelled into the air or awarding points to the defensive team of players if the defensive team of players catches the object before the object strikes the playing field. The method of playing a flying disc game may include awarding points to the offensive team of players if the flying disc strikes the target of both of the first pair of goal posts and the second pair of goal posts and causes both of the objects to be propelled into the air or awarding points to the defensive team of players if the defensive team of players catches both of the objects before either of the objects strikes the playing field. The method of playing a flying disc game may include accumulating the first set of players and the second set of players during the flying disc game and declaring a winner of the flying disc game when a predetermined threshold of points is achieved by either the first set of players or the second set of players. The first pair of goal posts and the second pair of goal posts all include a spike section positioned on a bottom section and where the positioning a first pair of the goal posts and the positioning of the second pair of goal posts is achieved by inserting the spike sections into the playing field. The method of playing a flying disc game may include providing a first portable base assembly and a second portable base assembly, the first portable base assembly and a second portable base assembly each may include a frame may include a top portion, a bottom portion opposite the top portion, a first side portion connecting a first end of the top portion to a first end of the bottom portion and a second side portion connecting a second end of the top portion to a second end of the bottom portion a base plate rotatably coupled to the frame proximate the bottom portion a pair of post holders mounted to the frame and at least one attachment hook positioned on the top portion of the frame providing a first foundation and a second foundation, the first foundation and a second foundation each may include a hollow rectangular cuboid having a bottom side and a front side and an upper edge positioned on the front side attaching the at least one attachment hook of the first portable base assembly over the upper edge of the first foundation and attaching the at least one attachment hook of the second portable base assembly over the upper edge of the second foundation. The method of playing a flying disc game may include positioning the base plate of the first portable base assembly between the bottom of the first portable base assembly and the playing field with the pair of post holders of the first portable base assembly positioned in a vertical orientation positioning the base plate of the second portable base assembly between the bottom of the second portable base assembly and the playing field with the pair of post holders of the positioning the base plate of the first portable base assembly between the bottom of the first portable base assembly and the playing field with the pair of post holders of the first portable base assembly positioned in a vertical orientation portable base assembly positioned in a vertical orientation releasably positioning the first pair of goal posts in the pair of post holders of the first portable base assembly and releasably positioning the second pair of goal posts in the pair of post holders of the second portable base assembly.

BRIEF DESCRIPTION OF THE DRAWINGS

So that the manner in which the above-recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

In the following detailed description of the embodiments, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

Figure 1:
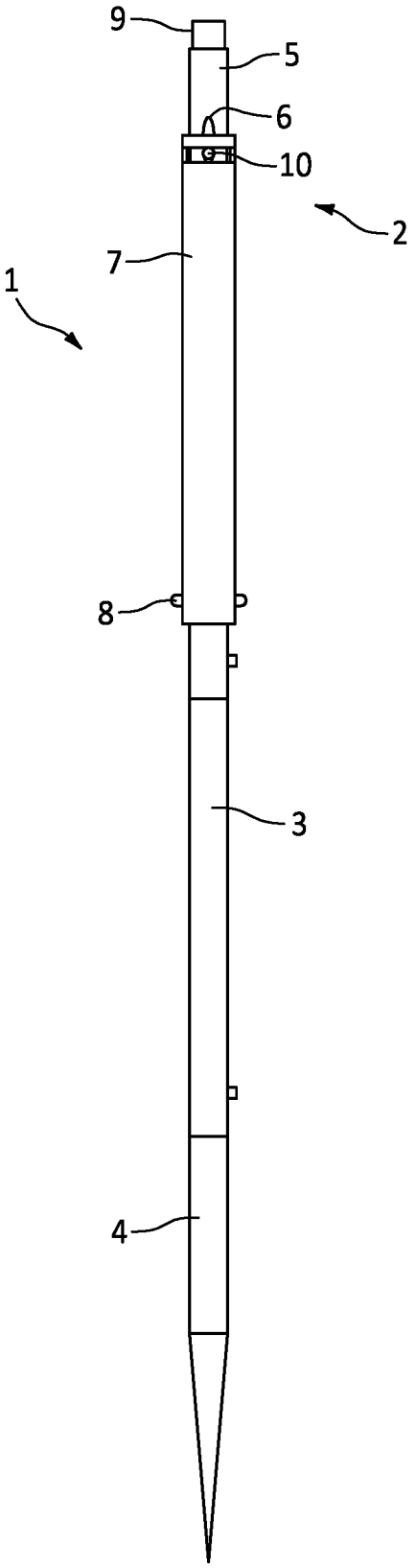
FIG. 1 is a rear view of a goal post in accordance with the present disclosure.
Figure 2:
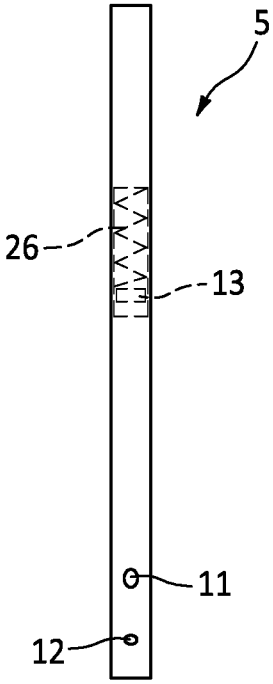
FIG. 2 is a side view of a top tube in partial section revealing a pop-up spring in accordance with the present disclosure.
Figure 3:
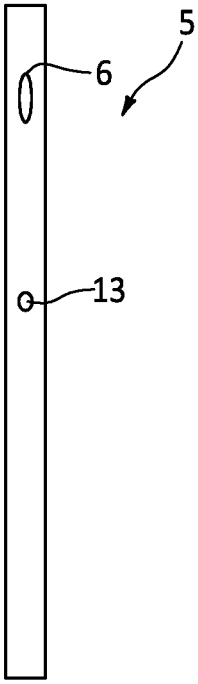
FIG. 3 is a rear view of a top tube in accordance with the present disclosure.

Referring to FIG. 1, there is shown a front view of goal post 1 in an embodiment of the present disclosure. Goal post 1 is a generally elongated pole includes three axially aligned sections of tubing including a top section 2 removably coupled to middle section 3 which is in turn removably coupled to bottom section 4. Top section 2 includes top tube 5 which is a generally tubular body that including trigger slot 6, target 7 pivotably attached to the top tube by pivot pin 8, pop-up piston 9 shown in the armed position and spring biased within the top tube and slidably captured within the slot by trigger pin 10. Now with reference to FIGS. 2 and 3 there is shown top tube 5 including trigger slot 6 positioned in a front side, pivot hole 11 and top spring clip hole 12 positioned in orthogonal to the slot. Top tube 5 is of a tubular construction having an inside diameter and an outside diameter and a wall thickness defined thereby and is comprised of any suitable material such as heavy-duty plastics or metal. Pivot hole 11 is a through hole that goes through top tube 5 passing through its center axis and top spring clip hole 12 is disposed in only one side of the tube. Top tube 5 further includes spring stop 13 which can be comprised of a rod and securely positioned within the tube, spanning its inside diameter and essentially flush with the outside diameter. With particular attention to FIG. 2, a portion of top tube 5 has been shown in cut-away to reveal pop-up spring 26 in an uncompressed (unarmed) condition positioned inside of the top tube and positioned on top of spring stop 13. Pop-up spring 26 has an outside diameter slightly smaller than the inside diameter of top tube 5 and has an uncompressed height and a spring constant selected to provide sufficient potential energy when compressed into an armed position to propel an object with a predetermined amount of force as will be described in more detail herein after.

Figure 4:
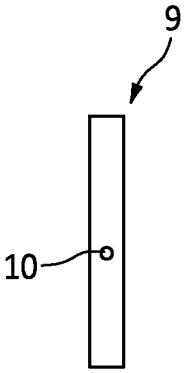
FIG. 4 is a rear view of a pop-up piston in accordance with the present disclosure.
Figure 5:
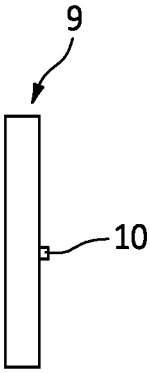
FIG. 5 is a side view of a pop-up piston in accordance with the present disclosure.

Referring next to FIGS. 4 and 5, pop-up piston 9 is shown with trigger pin 10 positioned on a back side of an outside surface thereof. Pop-up piston 9 is shown as a cylinder and can be solid or tubular having an outside diameter slightly smaller than the inside diameter of top tube 5 such that it can be slidably engaged within the top tube as will be described in more detail herein after. Pop-up piston 9 includes a platform 14 positioned on the top end for positioning an object upon as will be described in more detail herein after.

Figure 6:
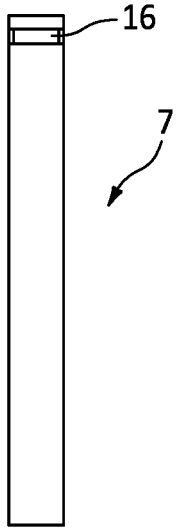
FIG. 6 is a rear view of a target in accordance with the present disclosure.
Figure 7:
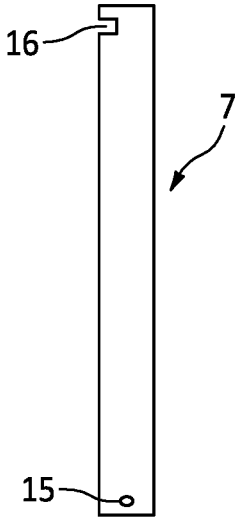
FIG. 7 is a side view of a target in accordance with the present disclosure.
Figure 8:
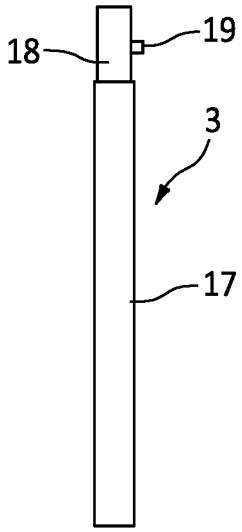
FIG. 8 is a side view of a middle tubular structure in accordance with the present disclosure.
Figure 9:
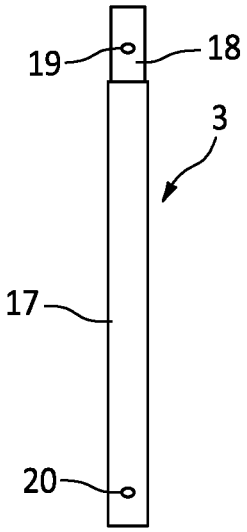
FIG. 9 is a rear view of a middle tubular structure in accordance with the present disclosure.

Referring now to FIGS. 6 and 7 there is shown target 7 including pivot hole 15 positioned through a bottom portion of the target and target slot 16 positioned near a top end of the target. Target 7 is comprised of any suitable material such as heavy duty plastics or metal and has an inside diameter appreciably larger than the outside diameter of top tube 5 such that it can pivot about pivot pin 8 to engage trigger pin 10 within target slot 16 in an armed position and release the trigger pin when appropriately struck by a flying disc as will be described in more detail herein after. Middle section 3 is best described with reference to FIGS. 8 and 9 wherein the middle section is comprised of a middle tubular structure 17 is an elongated tubular structure having an inside diameter and an outside diameter and a middle necked down section 18 positioned on the top of the main section having an outside diameter slightly smaller than that of the inside diameter of top tube 5. Middle tubular structure 17 and middle necked down section 18 can be comprised of a singular piece of material and can be similar in construction to that described herein above with reference to top tube. Middle section 3 further includes middle spring clip 19 positioned within middle necked down section 18 and adapted to cooperate with top spring clip hole 12 as will be described in more detail herein after. Middle section 3 further includes middle spring clip hole 20 is disposed through one side of the middle tubular structure 17.

Figure 10:
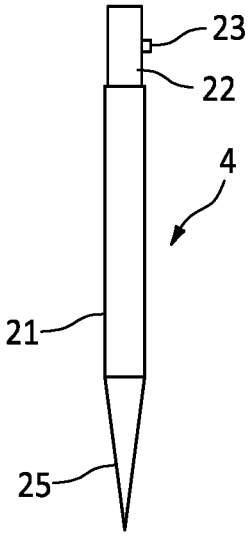
FIG. 10 is a side view of a bottom section in accordance with the present disclosure.
Figure 11:
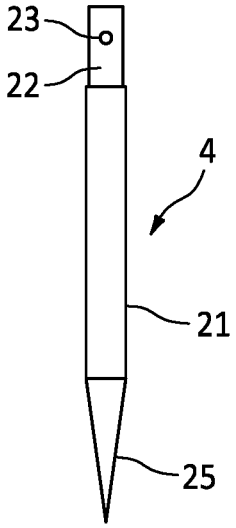
FIG. 11 is a rear view of a bottom section in accordance with the present disclosure.
Figure 12:
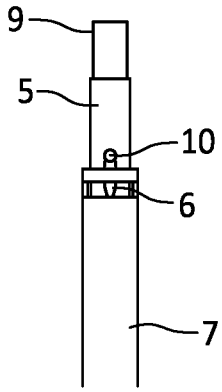
FIG. 12 is a rear view of the top portion of a goal post in an unarmed condition in accordance with the present disclosure.
Figure 13:
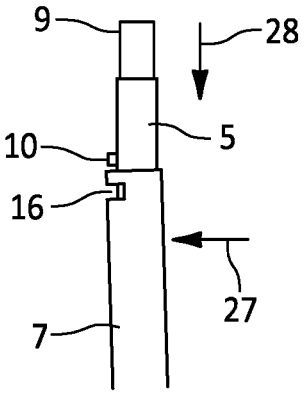
FIG. 13 is a side view of the top portion of a goal post in an unarmed condition in accordance with the present disclosure.

Now referring to FIGS. 10 and 11, there is shown an embodiment of bottom section 4 comprised of a bottom main tubular structure 21 having an inside diameter and an outside diameter and a bottom necked down section 22 positioned on the top of the bottom main section having an outside diameter slightly smaller than that of the inside diameter of middle tubular structure 17. Bottom main tubular structure 21 and bottom necked down section 22 can be comprised of a singular piece of material and can be similar in construction to that described herein above with reference to top tube 5. Bottom section 4 further includes bottom spring clip 23 positioned within bottom necked down section 22 and adapted to cooperate with middle spring clip hole 20 as will be described in more detail herein after. It should be recognized by those skilled in the art that middle spring clip 19 and bottom spring clip 23 can comprise a single end snap button spring clip as is known in the industry. Bottom section 4 further includes spike section 25 adapted to stably position goal post 1 in a vertical orientation within the ground in accordance with some embodiments of the present disclosure.

The assembly operation of goal post 1 can best be described with reference back to FIGS. 1-11. Top section 2 is assembled by positioning spring stop 13 within top tube 5, inserting pop-up spring 26 within the top tube and resting against the spring stop and inserting pop-up piston 9 within the top tube. Pop-up piston 9 is then urged against pop-up spring 26 and slightly compressing the pop-up spring, producing a biasing force against the pop-up piston, whereupon trigger pin 10 can be inserted through trigger slot 6 and fixedly positioned into the side of the pop-up piston. Target 7 can be slid onto top tube 5 with trigger slot 6 aligned with trigger pin 10 and pivotally attached to the top tube by pivot pin 8 wherein in the pivot pin can comprise a bolt and nut combination or equivalent. Middle section 3 is releasably fixed to top section 2 by inserting middle necked down section 18 into a bottom end of the top tube, aligning the button end of middle spring clip 19 with top spring clip hole 12 and urging the button end therethrough. Similarly, bottom section 4 is releasably fixed to middle section 3 by inserting bottom necked down section 22 into the bottom of the middle tubular structure 17, aligning the button end of bottom spring clip 23 with middle spring clip hole 20 and urging the button end therethrough. Once assembled as disclose, goal post 1 comprised a single unitary structure wherein the goal post is a generally rigid column which resists the whipping action of the prior art. In some embodiments, goal post 1 is approximately 5 feet tall in the fully assembled condition.

Figure 14:
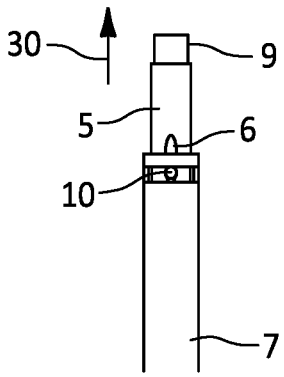
FIG. 14 is a rear view of the top portion of a goal post in an armed condition in accordance with the present disclosure.
Figure 15:
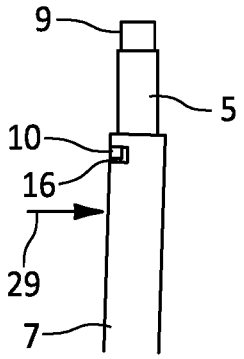
FIG. 15 is a side view of the top portion of a goal post in an armed condition in accordance with the present disclosure.

The arming operation of pop-up piston 9 of goal post 1 is best disclosed with reference to FIGS. 12-15. Pop-up piston 9 is shown in the upward position, or fired position, in FIGS. 12-13 and user starts the arming operation by pivoting target 7 in rearward direction 27 of goal post 1. The user can then urge pop-up piston in downward direction 28 and in so doing compresses pop-up spring 26 (FIG. 2) to its fullest compressed downward position wherein it has its largest potential energy. With reference to FIGS. 14-15 the user finishes the arming operation by pivoting target 7 in the forward direction 29, positioning trigger pin 10 within target slot 16 and releasing the pop-up piston. It should be appreciated by those skilled in the art that pop-up spring 26 biases pop-up piston 9 in the upward direction 30 forcing trigger pin 10 against the upper edge of target slot 16 releasably positioning the pop-up piston in the armed condition. In certain embodiments, and with reference back to the earlier figures, a self-pivoting pivoting of the present invention is disclosed. The self-pivoting goal post 1 includes a spiral torsion spring positioned inside of top tube 5 with the spiral body of the spiral torsion spring positioned over pivot pin 8 and a first leg of the spiral torsion spring resting against an inner surface of the top tube. Top tube 5 further includes an access hole through which a second leg of the spiral torsion spring protrudes and contacts an inside surface of target 7. The spiral torsion spring is sized such that it provides a bias force between top tube 5 and target 7 to rotatably pivotally bias the target to rest against trigger 10. In so doing a user can simply urge pop-up piston 9 in downward direction 28 and in so doing compresses pop-up spring 26 (FIG. 2) to its fullest compressed downward position wherein it has its largest potential energy and trigger 10 will engage with trigger slot 16 automatically.

Figure 16:
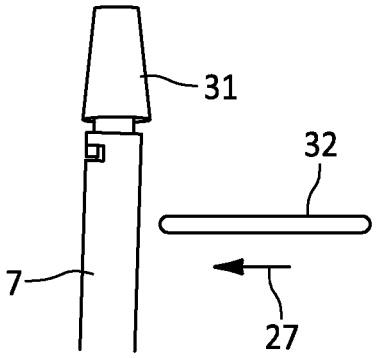
FIG. 16 is a side view of the top portion of a goal post in an armed condition in accordance with the present disclosure.

Referring now to FIG. 16, in operation goal post 1 is shown in the armed condition with an object 31, in this embodiment a cup. placed in an inverted position over the top portion of pop-up piston 9. It should be recognized by those skilled in the art that any suitable object can be selected and may be placed on top of pop-up piston 9 and that the pop-up piston may include a stabilizing platform for the object to rest upon without departing from the spirit and scope of this disclosure. As part of flying disc game, the disclosure of an embodiment thereof which will be disclosed hereinafter, a user throws a flying disc 43 at the front portion of target 7 in the rearward direction 27. As the flying disc continues in the rearward direction, and now referring to FIG. 17, and as a beneficial goal of the game, it strikes target 7 with an adequate amount of force to cause the target to pivot about pivot pin 8 (FIG. 1) thereby releasing trigger pin 10 from target slot 16 wherein pop-up spring 26 (FIG. 2) thrusts pop-up piston 9 in the upward direction 30 with sufficient force to dislodge object 31 from the pop-up piston and propels high up into the air. In embodiments that use the spiral torsion spring, the flying disc has to strike target 7 with an adequate amount of force to cause the target to overcome the bias force of the spiral torsion spring to pivot about pivot pin 8 (FIG. 1) thereby releasing trigger pin 10 from target slot 16 wherein pop-up spring 26 (FIG. 2) thrusts pop-up piston 9 in the upward direction 30 with sufficient force to dislodge object 31 from the pop-up piston and propels high up into the air. Once object 31 has reached its maximum trajectory gravity will then cause it to return to earth. It should be understood by those skilled in the art that the pop-up piston of the present disclosure inventively provides an upward trajectory to object 31 that is not found in the prior art.

Figure 17:
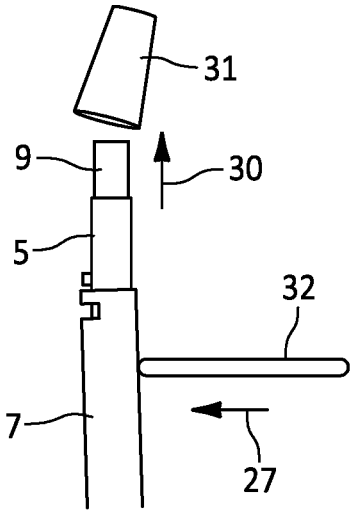
FIG. 17 is a side view of the top portion of a goal post in an unarmed condition in accordance with the present disclosure.
Figure 18:
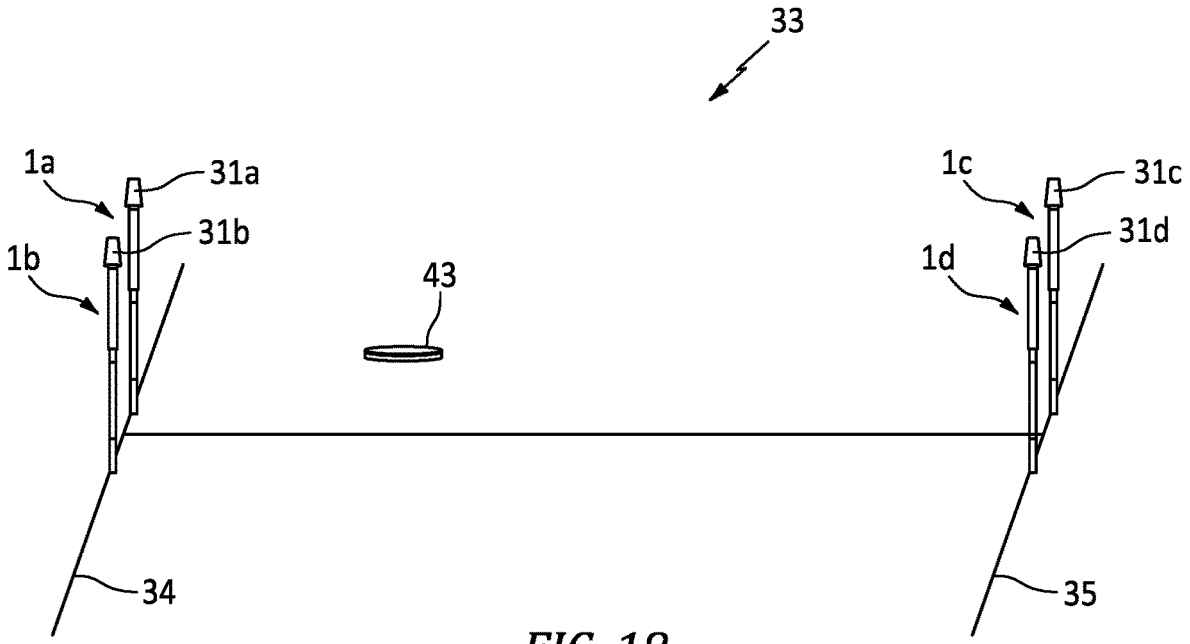
FIG. 18 is a perspective view of a playing field including a plurality of goal posts in accordance with the present disclosure.

Some embodiments of the present disclosure relate to methods of playing a flying disc game utilizing a plurality of goal posts 1 (FIG. 1). Referring to FIG. 18 there is provided an illustration of a particular configuration of goal posts **1*a*-1*d* for playing a flying disc game in accordance with some embodiments of the current disclosure. The field of play 33 include goal posts 1*a*, 1*b* inserted into the ground at a first team's goal line 34 approximately 18 inches apart from one another along the goal line. A second set of goal posts 1*c*, 1*d* are inserted into the ground at a second team's goal line 35 approximately 18 inches apart from one another along the goal line at predetermined distance away from goal line 34, which in some embodiments can be 25 feet. Goal lines 34, 35 can be established as boundary lines for the respective teams. The goal poles 1*a*-1*d* are rotationally oriented such that target slot 16 faces away from the field of play 33 or in the rearward direction 27 (FIG. 17). At the beginning of play each of the goal posts 1***a*-1*d* is placed in the armed condition as described herein before. An object 31*a*-31*d* (e.g., an inverted cup) is placed on top of the pop-up piston for each of the respective goal posts 1*a*-1*d*.

In one embodiment of the game, two teams of two players each are involved in play, though one or more players can constitute a team. Each team of two can stand behind the respective goal line and next to the pair of goal poles and objects they will defend. On embodiment of the game comprises only one hand to be used at all times during the game, though variations can be allowed for using both hands, or forcing users to use one hand while leaving the other hand free. One team can be designated the offensive team, i.e., the team throwing the flying disc, and the other team can be designated the defensive team, i.e., the team attempting to defend its object.

Play of an embodiment of the game can begin when a member of the offensive team tosses the flying disc without breaking its respective boundary line (goal line), in some cases in an effort to strike the target 7 area of one (or both) of the opposing team's goal post(s). The defensive team, the team whose goal posts is being thrown at, can try to catch the flying disc while maintaining a position behind their own boundary line. The defensive team tries to catch the flying disc only after it has crossed plane of goal posts/boundary line. If the flying disc strikes the target of the goal post(s), it can trigger the pop-up piston and cause the object to be propelled into the air as described herein before. In the case of such a triggering event the defensive team attempts to catch the the object(s) before the object(s) strike the ground. In other cases, the offensive team tries to throw the flying disc between the pairs goal posts on the defensive team's end. The teams alternate turns acting as offensive players and defensive players. Players on a team can also alternate turns throwing the flying disc when the team is designated for offense. If the flying disc is tossed and does not travel the full distance to the defensive team's pole, the defensive team is allowed to throw the flying disc from the spot the flying comes to rest when defensive team reverts to offense.

Scoring for the game can be provided for in a number of ways. For one embodiment of the present disclosure, if the flying disc passes between the defensive team's goal posts without touching either goal post two points are awarded to the offensive team. In such a case, the opposing team gets one rebuttal shot. If, during the rebuttal shot, the flying disc passes between the opposing team's goal posts without touching either goal post, it negates the original throw and game play continues without any points being awarded.

If the flying disc strikes the target of an opponent's goal post and triggers the pop-up piston resulting in the object being propelled into the air the defensive team much catch the object before hitting the ground or one point is awarded to the offensive team. These types of points are awarded even if the flying disc strikes the ground and rolls or bounces one or more times off the ground, hitting the pole and causing the target object to hit the ground without triggering the pop-up piston. If the flying disc hits both of the defensive teams' goal posts and triggers the pop-up pistons resulting in both of the objects being propelled into the air, the defensive team must catch both of the objects before hitting the ground or one point is awarded to the offensive team for each of the objects that hit the ground. It should be appreciated by those skilled in the art the pop-up piston of the present disclosure provides an advantage over flying disc games of the prior art in that it adds an element of height to the object when dislodged from the post. The element of height makes the game more challenging in certain circumstances in that wind and angles could cause the object to travel further from the post than the prior art and could cause an unpredictable path of trajectory to occur. It is contemplated by the present disclosure that points can be awarded upon the occurrence of predetermined events during the course of play. Play can continue until a predetermined threshold of points is accumulated by either team.

In certain embodiments of the game, the defensive team is not required to catch the flying disc. In other embodiments, to prevent the offensive team from scoring points, the defensive team tries to catch the flying disc before it hits the ground. If the defensive team crosses their respective boundary line and catches the flying disc in front of the goal posts, certain points can be awarded to the offensive team. In other embodiments of the game, the first team to reach a predetermined number of points (e.g. 5 points) is declared the winner. In some variations, a team must win by at least two points, therefore higher scores are possible.

Many variations of the game's rules can be implemented within the scope of the present disclosure. For example, more than two teams can be involved, where only two teams can be on the field of play 33 at one. When a team is designated the winner, the winning team stays on the playing field for the next opponents and has the ability to pick which side they would like to play on. Winners can also have the ability, if they would like, to throw the flying disc first to start the game. Other embodiments of the game of the present disclosure include using various types of flying objects other than discs (e.g., balls, other projectiles, etc.); varying the distances between the poles, the number of goal posts, the types of objects utilized, the number of points designated for various actions, the total score to be played to. Such variations can adjust the difficulty of the game depending upon the skill level/age of the players. In some instances, the game can be played with any combination of the specific kits, poles, bases for all surfaces, flying discs, and target objects disclosed in the present application. As well, one or more additional rules can be added or omitted relative to the renditions discussed herein. Any combination of these variations can be utilized in an embodiment of the invention.

Figure 19:
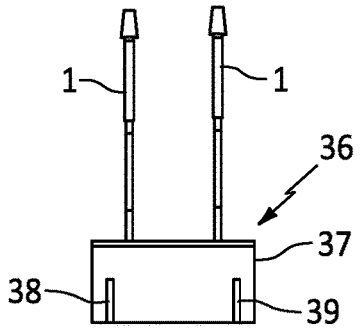
FIG. 19 is a front view of a base and plurality of goal posts in accordance with the present disclosure.
Figure 20:
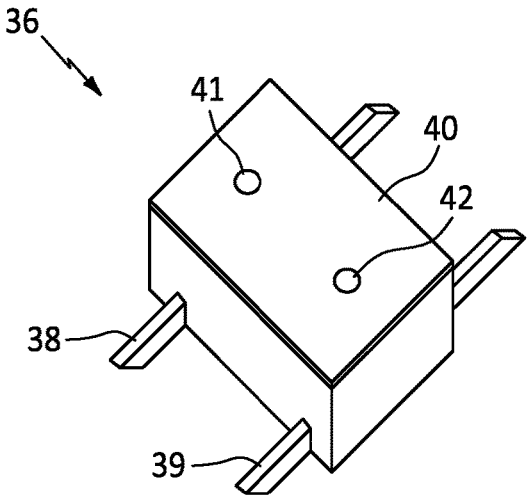
FIG. 20 is a perspective view of a base in accordance with the present disclosure.

Although goal post 1 is described herein above as having a spike section 25 (FIGS. 10 and 11) and being stabilized by inserting the spike section into the ground, other embodiments are contemplated by the present disclosure. One such alternative embodiment is shown in FIGS. 19 and 20 which includes base 36. Base 36 can be comprised of any suitable material including wood, plastic and metal. Base 36 is basically a rectangular cuboid that includes stabilizing legs 38, 39 having cutout features (not shown) to cooperate with slots in box 37 to stabilize the goal posts on top of the ground or on a floor. Base 36 further includes a top 40 which can be hingedly attached to box 37 or positioned inside a lip of the box. Top 40 includes post holes 41, 42 optimally spaced apart and sized to position a pair of goal posts 1 there in and stably position them for play as described herein above. For proper play a pair of bases 36 can be needed. In some embodiments the pair of bases can comprises two different sizes such that a smaller base can fit inside of the larger base. In still further embodiments box 37 can be sized to fit a smaller base box, top, 4 legs, all of the components for 4 goal posts, the objects and flying disc(s) to provide a kit for portable transport of the entire game disclosed herein above. It should be appreciated by those skilled in the art that base 36 allows for set up and play indoors or on surfaces that cannot be penetrated by spike section 25 (e.g. rock, ice, driveways, etc.).

Figure 21:
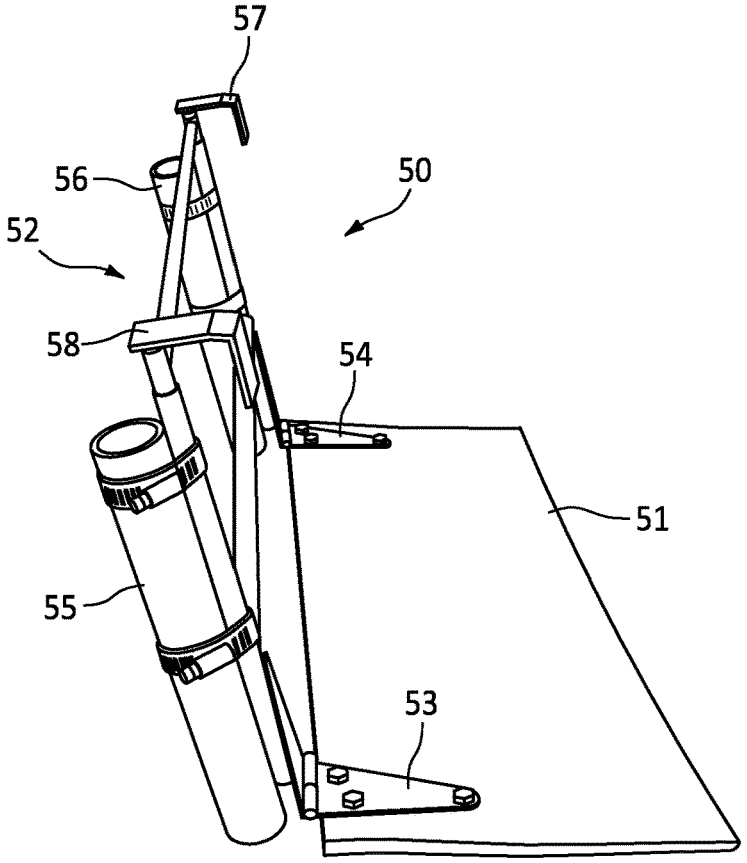
FIG. 21 is a perspective view of a portable base assembly in accordance with the present disclosure.
Figure 22:
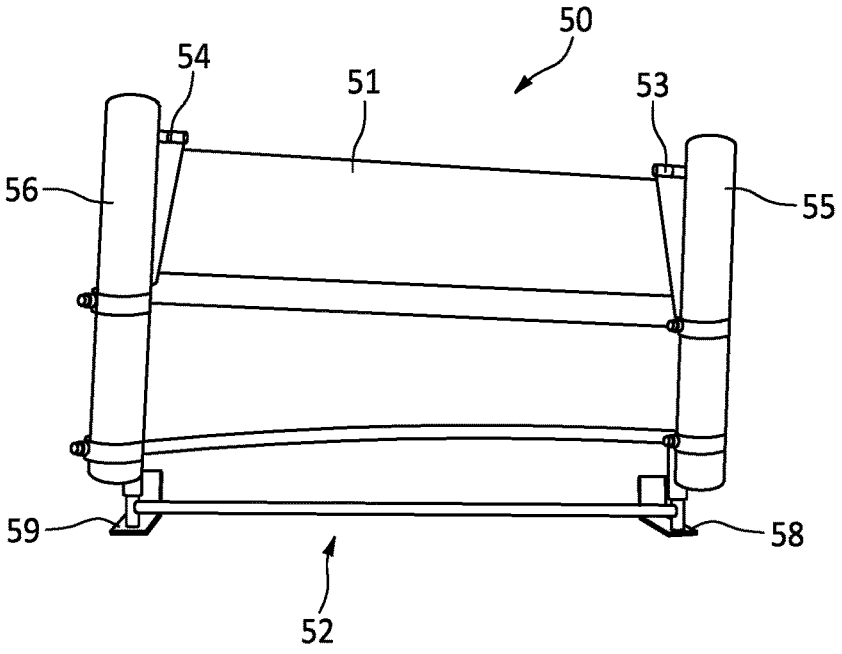
FIG. 22 is a front view of a portable base assembly in accordance with the present disclosure.
Figure 23:
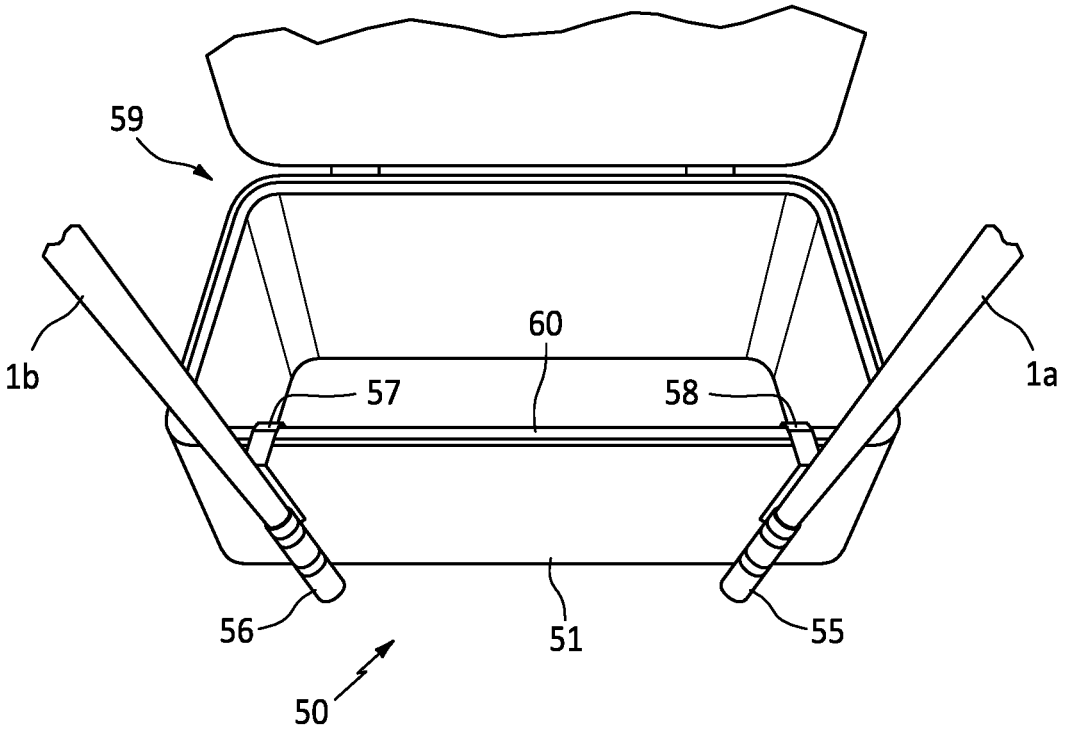
FIG. 23 is a top perspective view of a portable base assembly installed in a foundation in accordance with the present disclosure.
Figure 24:
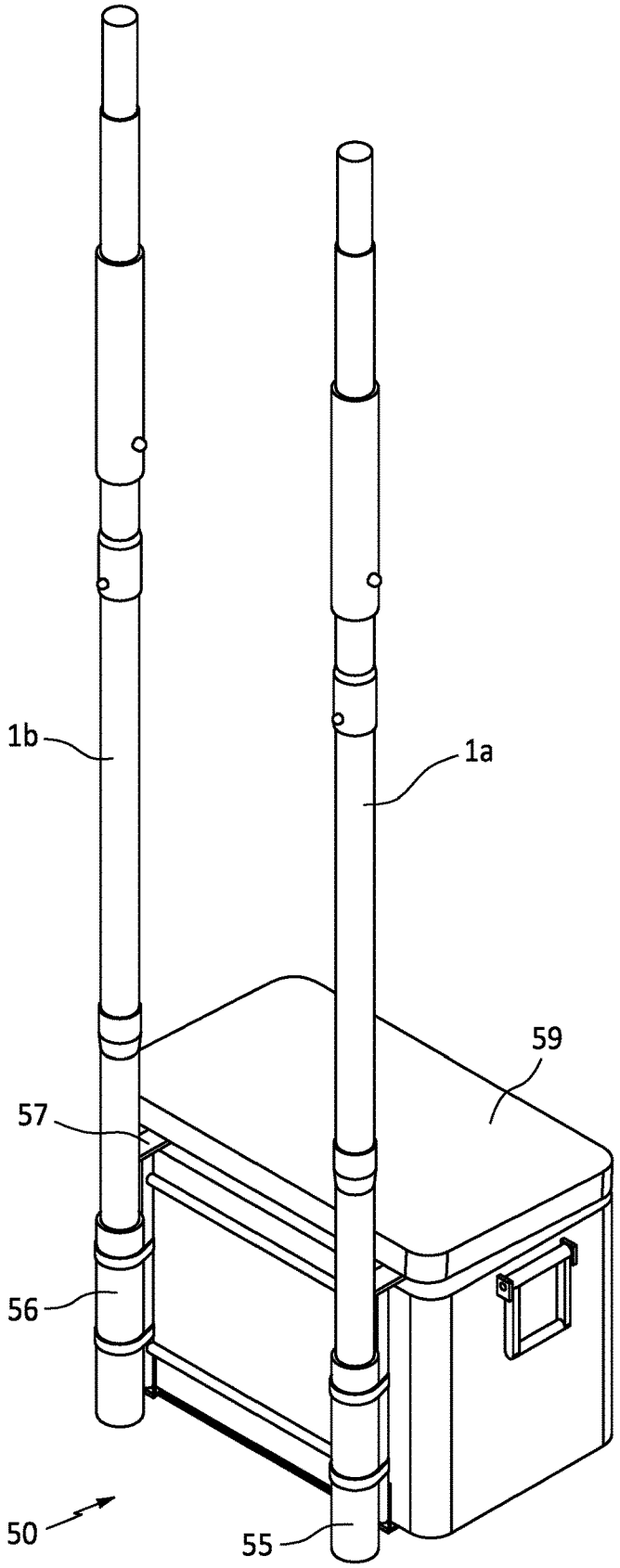
FIG. 24 is a side perspective view of a portable base assembly and foundation including a plurality of goal posts in accordance with the present disclosure.

Referring now to FIG. 21, there is shown a portable base assembly 50 in an open position that includes base plate 51, pivotally attached to frame 52 by hinges 53, 54 and post holders 55, 56 attached to the frame. Frame 52 includes a pair of side portions connecting the top of the frame to the bottom of the frame and further includes attachment hooks 57, 58 positioned along the top portion of the frame for removeable attachment portable base assembly 50 to a foundation as will be disclosed in more detail herein after. Now referring to FIG. 22 portable base assembly 50 is shown in a closed position wherein base plate 51 is pivotally positioned against frame 52 for ease of transport and storage. In operation, and with further reference to FIGS. 23, 24, portable base assembly 50 can be attached to a suitable foundation 59 to stabilize the portable base assembly for use. In this particular embodiment foundation 59 is shown as a cooler, but can be any hollow cuboid or similar object, and can be filled with ice and other articles to provide addition weight to aid in stabilizing portable base assembly 50. A user can position portable base assembly 50 in the open position (FIG. 20) and engage attachment hooks 57, 58 over an upper edge 60 of foundation 59 and place the foundation on top of base plate 51 with a bottom side of the foundation opposite of lid 59 releasably capturing the base plate between the bottom side and the ground. The user can then close the lid of foundation 59 releasingly capturing attachment hooks 57, 58 and securing portable base assembly 50 thereby. Post holders 55-56, are optimally spaced apart and sized to position a pair of goal posts 1 there in and stably position them for play as described herein above. For proper play a pair of portable base assemblies can be needed. It should be appreciated by those skilled in the art that portable base assembly 50 allows for set up and play indoors or on surfaces that cannot be penetrated by spike section 25 (e.g. rock, ice, driveways, etc.). Although described with reference to disc throwing game disclosed herein, portable base assembly 50 can be used for any type of device having a pole that needs to be temporarily vertically positioned in a stable manner.

Now with reference to FIG. 25, there is shown an alternative embodiment of goal post 1 wherein pop up spring 61 is configured to allow a user to position pop-up piston 9 into the armed (down) position using a single hand.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated other The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

While the foregoing is directed to embodiments of the present invention, other and further embodiments of the invention may be devised without departing from the basic scope thereof, and the scope thereof is determined by the claims that follow.

What is claimed is:

1. A goal post comprising:
   - an elongated pole having a top section and a bottom section, wherein at least a portion of the top section comprises a tubular body, wherein the tubular body includes an axially elongated trigger slot disposed therein;
   - a pivot pin disposed through the top section;
   - a target comprising an elongated tubular structure disposed over a portion of the top section and pivotably attached to the pivot pin, the target further having a target slot transversely positioned on a back side thereof;
   - a spring disposed within the tubular body; and
   - a piston having a trigger pin disposed in a side thereof, the piston disposed within the tubular body positioned against the spring, the trigger pin retained within the axially elongated trigger slot, wherein the spring is configured to produce a biasing force against the piston.

2. The goal post of claim 1 wherein the piston is configured to be positioned in a downward position and the trigger pin positioned within the target slot in an armed position.

3. The goal post of claim 2 wherein the target is configured to pivot about the pivot pin when the target is impacted by an object causing the trigger pin to be released from the target slot and the spring to force the piston into an upward position in a fired position.

4. The goal post of claim 3 further comprising an object disposed on a top portion of the piston in the armed position and wherein the object is ejected from the top portion of the piston in the fired position.

5. The goal post of claim 1 further comprising:
   - a middle section positioned between the top section and the bottom section wherein a top end of the bottom section is slidably removably connected to a bottom end of the middle section and a top end of the middle section is slidably removably connected to a bottom end of the top section.

6. The goal post of claim 5 further comprising a spike positioned on a bottom end of the bottom section wherein the spike is adapted to stably position the goal post in a vertical orientation within a portion of the ground.

7. A flying disc game comprising:
   - a plurality of goal posts, each goal post comprising:
     - an elongated pole having a top section and a bottom section, wherein at least a portion of the top section comprises a tubular body, wherein the tubular body includes an axially elongated trigger slot disposed therein;

a pivot pin disposed through the top section;

a target comprising an elongated tubular structure disposed over a portion of the top section and pivotably attached to the pivot pin, the target further having a target slot transversely positioned on a back side thereof;

a spring disposed within the tubular body;

a piston having a trigger pin disposed in a side thereof, the piston disposed within the tubular body positioned against the spring, the trigger pin retained within the axially elongated trigger slot, wherein the spring is configured to produce a biasing force against the piston; and the piston configured to be positioned in a downward position and the trigger pin positioned within the target slot in an armed position;

an object disposed on a top portion of the piston each of the plurality of goal posts in the armed position;

at least one flying disc; and wherein one of the targets is configured to pivot about the pivot pin when the target is impacted by the at least one flying disc causing the trigger pin is to be released from the target slot and the spring to force the piston into an upward position in a fired position and ejecting the object from the piston.

8. The flying disc game of claim 7 further comprising:

a plurality of bases, each of the plurality of bases comprising a rectangular cuboid that includes at least one hole in a top configured to releasably stabilize at least one of the plurality of goal posts therein and a plurality of legs configured to stabilize the base.

9. The flying disc game of claim 7 further comprising:

at least one portable base assembly comprising:

a frame comprising a top portion, a bottom portion opposite the top portion, a first side portion connecting a first end of the top portion to a first end of the bottom portion and a second side portion connecting a second end of the top portion to a second end of the bottom portion;

a base plate rotatably coupled to the frame proximate the bottom portion;

at least one post holder mounted to the frame and configured to releasably position at least one of the plurality of goal posts therein; and at least one attachment hook positioned on the top portion of the frame.

10. The flying disc game of claim 9 further comprising:

a foundation comprising a hollow rectangular cuboid having a bottom side and a front side and an upper edge positioned on the front side; and wherein at least one attachment hook is adapted to be positioned over the upper edge and wherein a base plate is configured to be positioned against the bottom side to position the at least one post holder in a vertical position and to releasably secure at least one portable base assembly to the foundation.

11. A method of playing a flying disc game comprising:

supplying at least two goal posts, each goal post comprising:

an elongated pole having a top section and a bottom section, wherein at least a portion of the top section comprises a tubular body, wherein the tubular body includes an axially elongated trigger slot disposed therein;

a pivot pin disposed through the top section;

a target comprising an elongated tubular structure disposed over a portion of the top section and pivotably attached to the pivot pin, the target further having a target slot transversely positioned on a back side thereof;

a spring disposed within the tubular body;

a piston having a trigger pin disposed in a side thereof, the piston disposed within the tubular body positioned against the spring, the trigger pin retained within the axially elongated trigger slot, wherein the spring is configured to produce a biasing force against the piston; and the piston configured to be positioned in a downward position and the trigger pin positioned within the target slot in an armed position;

the target is configured to pivot about the pivot pin when the target is impacted by a flying disc causing the trigger pin is to be released from the target slot and the spring to force the piston into an upward position in a fired position;

positioning the at least two goal posts in a vertical orientation a first distance apart;

setting the at least two goal posts in the armed position;

placing an object on a top portion of each of the at least two goal posts;

attempting to strike the target with the flying disc, by an offensive player, of at least one of the at least two goal posts; and attempting to catch the object, by a defensive player, if the flying disc strikes the target and the object is ejected from at least one of the at least two goal posts by the piston in the fired position.

12. The method of playing a flying disc game of claim 11, further comprising:

supplying a first pair of goal posts and a second pair of goal posts each configured to propel an object in an upward direction when the target of the first pair of goal posts and the second pair of goal posts is struck with the flying disc;

positioning a first pair of the goal posts in a vertical orientation at a first end of a playing field separated by a second distance apart along a first goal line;

positioning the second pair of goal posts in a vertical orientation at a second end of a playing field separated by a third distance apart along a second goal line; and wherein the first goal line and the second goal line are parallel to each other and are positioned at the first distance apart.

13. The method of playing a flying disc game of claim 12, further comprising:

providing a first set of players and a second set of players;

alternating the first set of players and the second set of players between an offensive team of players and a defensive team of players; and awarding points to the first set of players and the second set of players upon an occurrence of predetermined events.

14. The method of playing a flying disc game of claim 13, further comprising:

propelling the flying disc by one the offensive team of players at one of the first pair of goal posts and the second pair of goal posts; and awarding points to the offensive team of players if the flying disc passes between, without striking, one of the first pair of goal posts and the second pair of goal posts.

15. The method of playing a flying disc game of claim 13, further comprising:

awarding points to the offensive team of players if the flying disc strikes the target of one of the first pair of goal posts and the second pair of goal posts and causes the object to be propelled into the air or awarding points to the defensive team of players if the defensive team of players catches the object before the object strikes the playing field.

16. The method of playing a flying disc game of claim 13, further comprising:

awarding points to the offensive team of players if the flying disc strikes the target of both of the first pair of goal posts and the second pair of goal posts and causes both of the objects to be propelled into the air or awarding points to the defensive team of players if the defensive team of players catches both of the objects before either of the objects strikes the playing field.

17. The method of playing a flying disc game of claim 13, further comprising:

accumulating the first set of players and the second set of players during the flying disc game; and declaring a winner of the flying disc game when a predetermined threshold of points is achieved by either the first set of players or the second set of players.

18. The method of playing a flying disc game of claim 12, wherein the first pair of goal posts and the second pair of goal posts all include a spike section positioned on a bottom section and wherein the positioning a first pair of the goal posts and the positioning of the second pair of goal posts is achieved by inserting the spike sections into the playing field.

19. The method of playing a flying disc game of claim 12, further comprising:

providing a first portable base assembly and a second portable base assembly, the first portable base assembly and a second portable base assembly each comprising:

a frame comprising a top portion, a bottom portion opposite the top portion, a first side portion connecting a first end of the top portion to a first end of the bottom portion and a second side portion connecting a second end of the top portion to a second end of the bottom portion;

a base plate rotatably coupled to the frame proximate the bottom portion;

a pair of post holders mounted to the frame; and at least one attachment hook positioned on the top portion of the frame;

providing a first foundation and a second foundation, the first foundation and a second foundation each comprising a hollow rectangular cuboid having a bottom side and a front side and an upper edge positioned on the front side;

attaching the at least one attachment hook of the first portable base assembly over the upper edge of the first foundation; and attaching the at least one attachment hook of the second portable base assembly over the upper edge of the second foundation.

20. The method of playing a flying disc game of claim 19, further comprising: positioning the base plate of the first portable base assembly between the bottom portion of the first portable base assembly and the playing field with the pair of post holders of the first portable base assembly positioned in a vertical orientation;

positioning the base plate of the second portable base assembly between the bottom portion of the second portable base assembly and the playing field with the pair of post holders of the base plate of the first portable base assembly between the bottom portion of the first portable base assembly and the playing field with the pair of post holders of the first portable base assembly positioned in a vertical orientation; portable base assembly positioned in a vertical orientation;

releasably positioning the first pair of goal posts in the pair of post holders of the first portable base assembly; and releasably positioning the second pair of goal posts in the pair of post holders of the second portable base assembly.

* * * * *